US005091615A

United States Patent [19]

Lippi et al.

[11] Patent Number: 5,091,615

[45] Date of Patent: Feb. 25, 1992

[54] VACUUM SWITCH

[75] Inventors: Bruno Lippi, Aarau; Ernst Suter, Kolliken; Thomas Meier, Niedergosgen, all of Switzerland

[73] Assignee: Sprecher Energie AG, Oberentfelden, Switzerland

[21] Appl. No.: 465,749

[22] Filed: Jan. 18, 1990

[30] Foreign Application Priority Data

Jan. 30, 1989 [CH] Switzerland ..... 294/89
Dec. 6, 1989 [CH] Switzerland ..... 377/89

[51] Int. Cl.[5] ..... H01H 33/66
[52] U.S. Cl. ..... 200/144 B
[58] Field of Search ..... 200/144 B, 145-148

[56] References Cited

U.S. PATENT DOCUMENTS 3,562,457 2/1971 Peck ..... 200/144 B
3,746,811 7/1973 Saito ..... 200/144 B
3,855,435 12/1974 Himi ..... 200/144 B
3,956,721 5/1976 Link ..... 200/144 B X
4,150,270 4/1979 Zunick ..... 200/144 B X
4,568,804 2/1986 Luehring ..... 200/144 B
4,618,749 10/1986 Bohmë et al. ..... 200/144 B

*Primary Examiner*—J. R. Scott
*Attorney, Agent, or Firm*—Fleit, Jacobson, Cohn, Price, Holman & Stern

[57] ABSTRACT

A housing of a vacuum switch has in an upper connecting region a passage, through which the connecting element is led. The latter engages with its end region in a recess, opposite the passage, in the housing. In the region of the passage, the connecting element is supported on a support tongue and clamped tight by a wedge-shaped retaining member. The vacuum switch chamber is bolted on to the connecting element. The connecting element can also be secured to the housing at the support point opposite the passage.

15 Claims, 4 Drawing Sheets

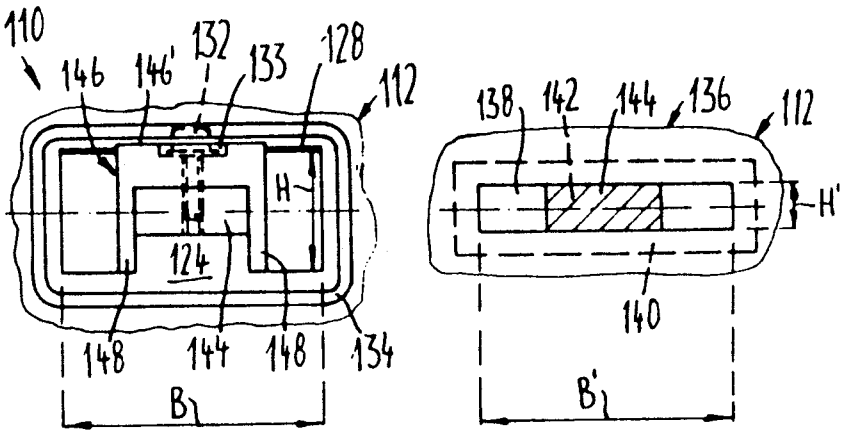
Fig. 11
Fig. 9
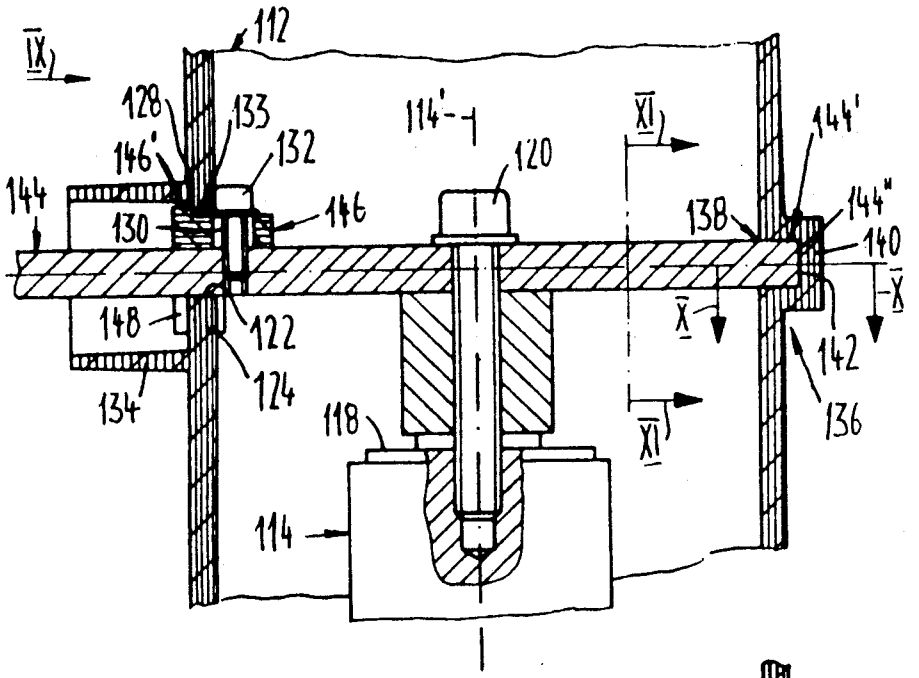
Fig. 8
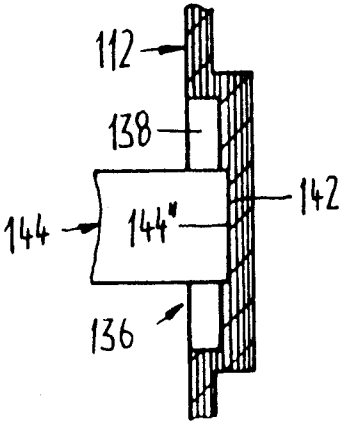
Fig. 10

VACUUM SWITCH

FIELD OF THE INVENTION

The present invention relates to a vacuum switch for medium voltage.

BACKGROUND OF THE INVENTION

Such a vacuum switch is known from DE-OS 3544972. A vacuum switch chamber is arranged in a cylindrical housing made of insulating material. Above this vacuum switch chamber a connecting element is provided, the clamping part of which, arranged inside the housing, embraces and clamps a connecting spigot, projecting in the axial direction, of the vacuum switch chamber. This clamping part is bolted to a connecting bolt which passes through the housing in the radial direction through a corresponding passage. At the end furthest away from the connecting bolt, the clamping part has a spigot which engages in a blind hole-like recess, diametrically opposite the passage, in the housing. The connecting bolt which is introduced from the outside into the passage is constructed to be flange-like and is bolted from the outside to the housing. When mounting the vacuum switch, the switch chamber is introduced eccentrically into the housing from above together with the clamping part premounted on it and is aligned in such a way that, when the spigot is subsequently centered, it comes to rest in the recess. The connecting bolt is then pushed through the passage in a radial direction from the outside and bolted to the clamping part and to the housing. This known vacuum switch is costly in terms of construction and mounting and requires the housing to have an inner diameter which allows the eccentric introduction of the clamping part together with the vacuum switch chamber.

SUMMARY OF THE INVENTION

Therefore it is an object of the present invention to propose a vacuum switch which is constructed in an extremely simple manner and which is extremely simple to mount, and the housing of which does not need to be substantially larger than the vacuum switch chamber.

The securing of the vacuum switch chamber in the axial direction to the connecting element requires, particularly in the radial direction, little space and permits a very simple securing mode, for example by means of a bolt. The slim construction of the connecting element which can be achieved by means of this permits the introduction of a one-piece connecting element through a passage which makes an enlargement of the housing unnecessary.

A particularly preferred embodiment of the vacuum switch permits a highly simple securing of the connecting element. Furthermore, it offers the possibility of securing connecting elements of different cross-section without alterations to the housing simply by adding a different retaining element to the housing.

A further preferred embodiment of the vacuum switch according to the invention permits the trouble-free securing of a connecting element, which is smaller both in height and width than the cross-section of the passage.

In an alternate embodiment, connecting elements of different cross-section are held secure in a single recess in the housing.

In a further particularly preferred embodiment, the connecting element constructed as one piece is secured to a support point on the housing opposite the passage. The connecting element is thus secured to the housing at the support point in relation to its longitudinal direction and is thus supported in the transverse direction at the passage and also at the support point. This embodiment requires, particularly in the region of the passage, little space, and allows a simple securing of the connecting element and a simple construction both of the connecting element and of the housing.

The connecting element can be clamped to the housing at the support point and glued or pinned or the like to the latter. However, in a preferred embodiment, the housing has at the support point a further passage running in the radial direction, which is penetrated by a spigot on the connecting element, on which a bracing part sits on the outside of the housing. Thus, the spigot can have a thread, on which a nut sits, in order to secure the connecting element to the housing. Such an embodiment permits very simple mounting.

In a preferred manner, the bracing part is covered with a covering of insulating material. By means of this, the dielectric strength is increased.

BRIEF DESCRIPTION OF THE DRAWINGS

The invention is now explained in detail with reference to the exemplary embodiments represented in the drawings, wherein, in purely diagrammatic form:

FIG. 8 shows in the same representation as FIG. 4 the connecting region of the vacuum switch with a connecting element which is smaller in cross-section, FIG. 9 shows a view of the connecting region in the direction of the arrow IX of FIG. 8, and FIGS. 10 and 11 show sections along the lines X—X and XI—XI according to FIG. 8, respectively.

DETAILED DESCRIPTION OF THE PREFERRED EMBODIMENTS

Figure 1:
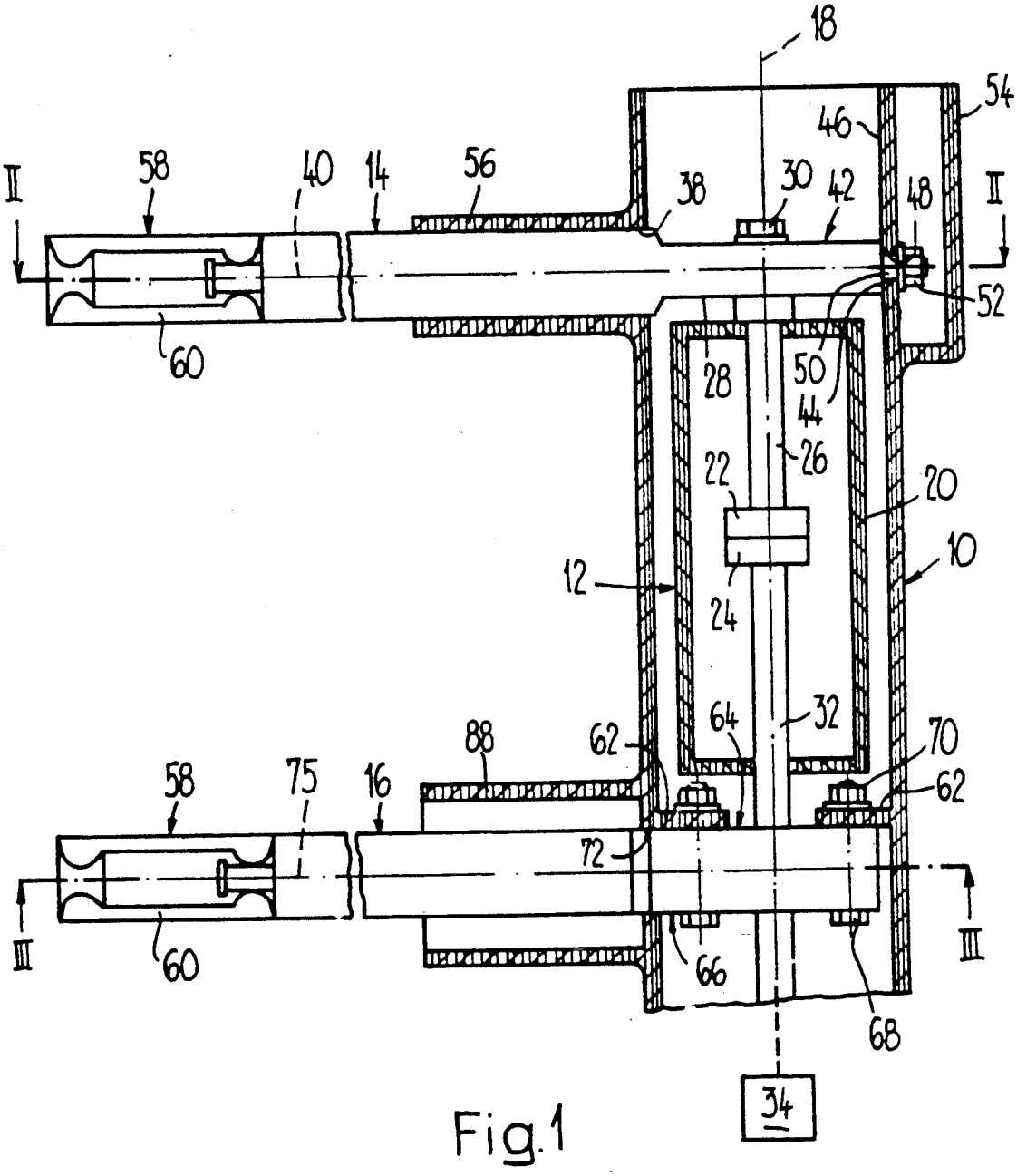
FIG. 1 shows a vertical section through a vacuum switch according to a first exemplary embodiment.
Figure 2:
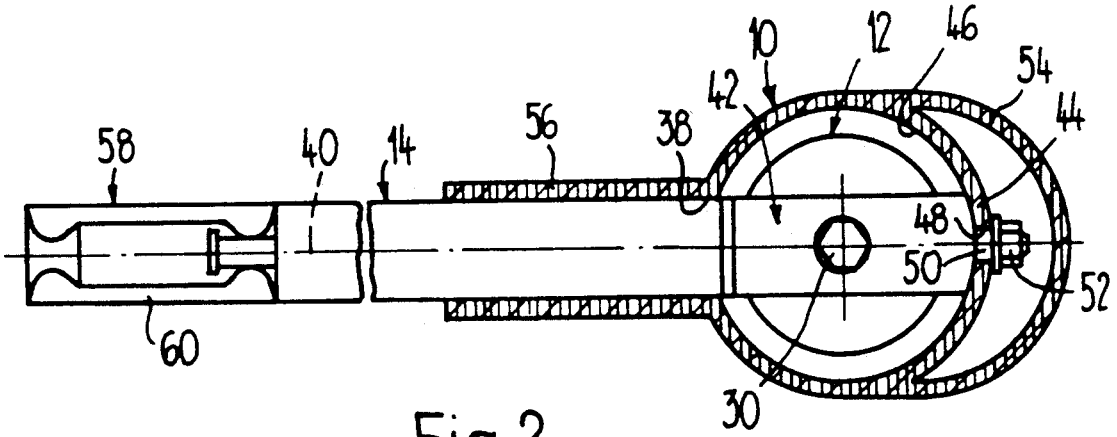
FIGS. 2 and 3 show a top view or bottom view of the vacuum switch, the housing being represented in section along the line II—II and line III—III of FIG. 1, respectively.
Figure 3:
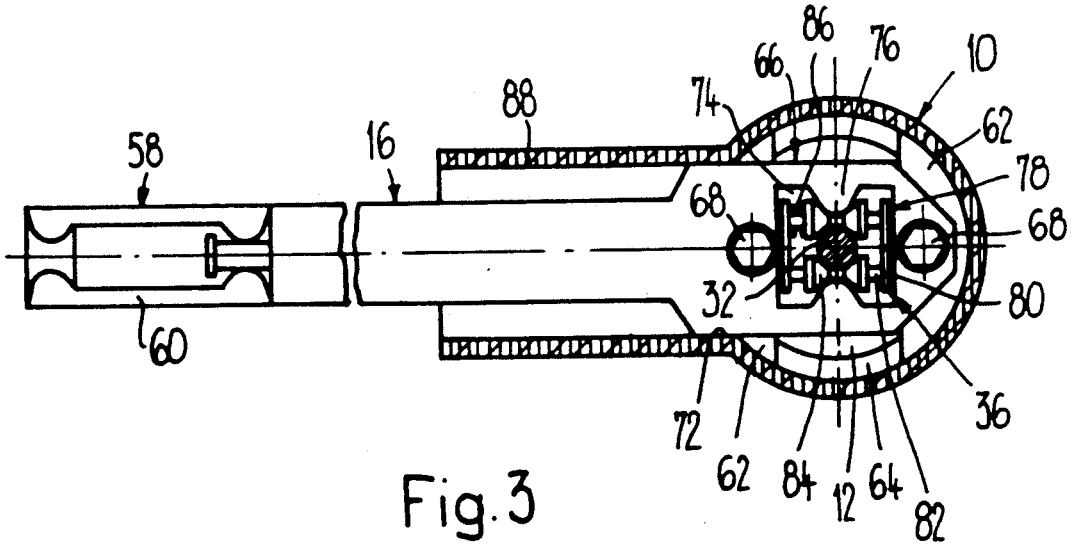

The vacuum switch for medium voltage represented purely diagrammatically in FIGS. 1 to 3 has a vacuum switch chamber 12 arranged in a cylindrical housing 10 made of insulating plastic. Above the vacuum switch chamber 12, there is, in the radial direction, a connecting element 14 and parallel to it and below the vacuum switch chamber 12 there is a connecting part 16 leading out of the housing 10 in order to make an electrical connection between the vacuum switch chamber 12 and connecting leads (not represented) or busbars.

The essentially cylindrical vacuum switch chamber 12, the longitudinal axis of which is designated by 18 and is indicated by dash-dot lines, is of generally known design and has switch contacts 22, 24 in a switch chamber housing 20 made of insulating material (FIG. 1). The upper fixed switch contact 22 is arranged on the end face of a contact pin 26, which leads in an axial direction through the switch chamber housing 20 and is permanently connected to the switch chamber housing. The contact pin 26 rests on the end face on a contact surface 28 of the connecting element 14 and is secured to the latter by means of a bolt 30 running in the axial direction. The vacuum switch chamber 12 is thus carried by the connecting element 14.

The lower movable switch contact 24 is arranged on the end face of a contact tappet 32 leading downwards in an axial direction out of the switch chamber housing 20 and which can be moved in the direction of the axis 18 from a switch-on position shown in FIG. 1 into a switch-off position and back again by means of a drive 34 indicated only diagrammatically. The contact tappet 32 is electrically connected to the connecting part 16 by means of a trolley contact arrangement 36 (FIG. 3).

The cylindrical housing 10 arranged coaxially to the vacuum switch chamber 12 has a passage 38 in the radial direction for the connecting element 14, which passage is matched to the cross-section of the connecting element 14. The connecting element 14 is in cross-section a square shaped piece with rounded corners, the longitudinal axis of which is indicated by 40. The connecting element 14 is constructed to be tapered in the direction of the longitudinal axis 18 of the vacuum switch chamber 12 in its section 42 arranged in the housing 10, and its end face 44 on this side lies on the inner surface 46 of the housing 10. The surface of the section 42 which, on mounting, is situated at the bottom forms the contact surface 28, on which the contact pin 26 rests.

In the housing 10, diametrically opposite the passage 38, there is a further passage 48 provided which is penetrated by a spigot 50 provided on the end face of the connecting element 14. The spigot 50 has a thread, not represented, into which a nut 52 is screwed in order to secure the connecting element 14 on the housing 18. The nut 52 is covered by a pocket-shaped covering 54 which is open toward the top in the axial direction and is formed on the housing 10.

The connecting element 14 is covered on a part of its length projecting above the housing 10 by a tubular covering element 56 formed on the housing 10. The connecting element 14 is thus supported on the one hand on the covering element 56 and at the passage 38, and on the other hand by means of the spigot 50 at the passage 48, and it is held in place on the housing 10 in the direction of its longitudinal axis 40 by means of the bolt connection 50, 52. The vacuum switch is constructed as an isolating switch and has at the free end of the connecting element 14 an isolating contact 58 with spring-loaded contact fingers 60.

The housing 10 has below the vacuum switch chamber 12 an intermediate floor 62 with an opening 64 for the contact tappet 32. The connecting part 16 constructed as one piece is secured from below to this intermediate floor 62 by means of two bolts 68 and nuts 70 running in the axial direction. The connecting part 16 is led out of the housing 10 through a passage 72 running directly below the intermediate floor 62 in a radial direction and has in its part projecting above the housing 10 an essentially square cross-section with rounded corners. The section 66, arranged in the housing, of the connecting part 16 broadens out in a shovel-shape, as can be seen particularly in FIG. 3. In the section 66, a passage 74 is provided running in the direction of the longitudinal axis 18, in which passage the trolley contact arrangement 36 is arranged and through which the contact tappet 32 is led. This passage 74 is constructed symmetrically in relation to a plane in which the longitudinal axis 18 of the housing 10 and the longitudinal axis, designated by 75, of the connecting part 16 lie; having an essentially square cross-section and projections 76 projecting inwardly and symmetrically in relation to the plane and running in the direction of the longitudinal axis 18. These projections 76 have in their end regions pointing toward one another a curve which approximately corresponds to the curvature of the contact tappet 32.

The trolley contact arrangement 36 has a trolley cage 78 with two plates 80 parallel to one another which are connected to one another by means of two shafts 82 running in the direction of the longitudinal axis 75 of the connecting part 16. These shafts 82 run on both sides of the contact tappet 32 and on each of them sits a pair of cone-shaped contact rollers 84 facing toward one another. These contact rollers 84 are pressed against the corresponding projection 76 and the contact tappet 32 by means of pressure springs 86 of which only one is represented in FIG. 3. When the switching tappet 32 moves, the contact rollers 84 roll against the projections 76 and the contact tappet 32, whereby the roller cage 78 is entrained in each case for half the travel of the contact tappet 32.

The connecting part 16 is covered over a part of its length which projects beyond the housing 10, by a tubular covering element 88 formed on the housing 10, the inner diameter of which is dimensioned in such a way that the inner section 66 can be introduced from the outside of housing 10 through this covering element 88 into the housing 10. The connecting part 16 also has on its free end an isolating contact 58 with contact fingers 60.

At the lower end of the housing 10, a moving carriage, not represented, is provided by means of which the vacuum switch can be displaced in the longitudinal direction of the connecting element 14 and of the connecting part 16 in order to connect and disconnect the isolating contacts 58 to and from counter contacts which are not represented. Of course, depending on the number of phases, a plurality of housings 10 with switching chambers 12 can be arranged on one moving carriage.

When mounting the vacuum switch, the connecting part 16 with its section 66 in advance is first introduced from the outside through the covering element 88 and the passage 72 into the housing 10 and secured by means of the bolts 68 and nuts 70 to the intermediate floor 62. Then, the vacuum switch chamber 12 together with the trolley contact arrangement 36 sitting on the contact tappet 32 is lowered from above into the housing 10 and the trolley contact arrangement 36 is introduced into the passage 74 in the section 66 of the connecting part 16. The connecting element 14 with its spigot 50 in advance is then pushed through the covering element 56 and the passage 38 until the end face 44 rests against the inner surface 46 of the housing 10 and the spigot 50 penetrates the passage 48. By mounting and tightening the nut 52 on to the spigot 50, the connecting element 14 is fixed in place. The mounting and tightening of the nut 52 can occur without difficulties through the pocket-shaped opening between the housing 10 and the covering 54. As a last step, the vacuum switch chamber 12 is then secured with the bolt 30 to the connecting element 14.

The connecting element 14 and the connecting part 16 do not necessarily have to be fixed to the housing 10 or to the intermediate floor 62 by means of bolts and nuts. It is also conceivable for snap-on connections or clamp connections to be provided. The cross-sections of the connecting element 14 and of the connecting part 16 can have any appropriate shape so they can, for example, be constructed to be round. The intermediate floor can also be formed by flange-like projections projecting toward the inside of the housing. Instead of isolating contacts 58, it is also conceivable for the connecting lines to be secured directly to the connecting element 14 or connecting part 16, for example by means of bolts.

Figure 5:
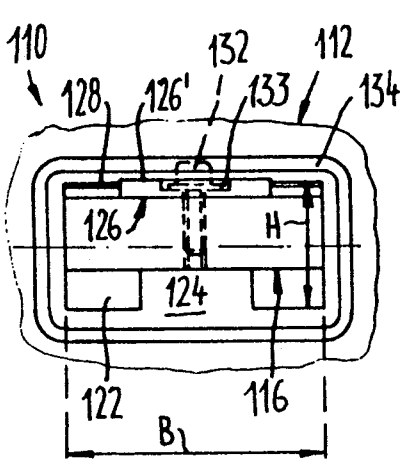
FIG. 5 shows a view of the same region of the vacuum switch in the direction of the arrow V according to FIG. 4, FIGS. 6 and 7 show sections along the lines VI—VI or VII—VII according to FIG. 4, respectively.
Figure 4:
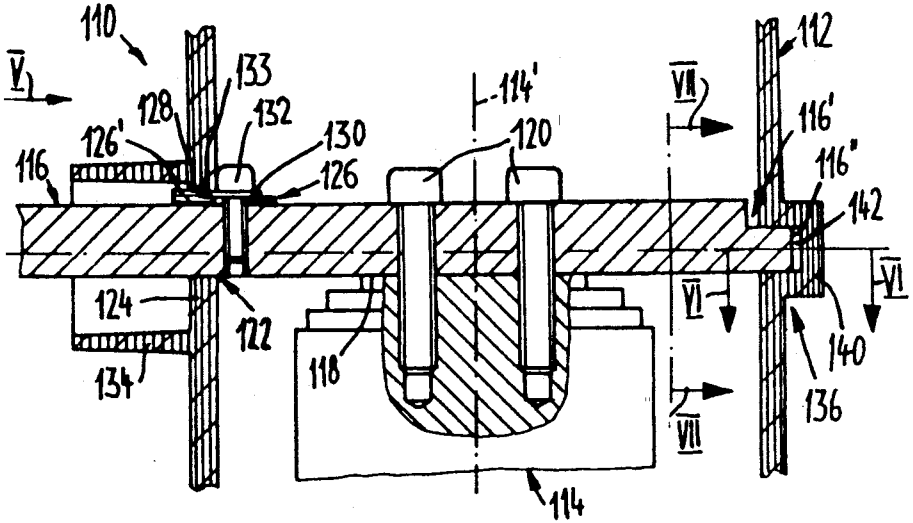
FIG. 4 shows a vertical section through a vacuum switch according to a second embodiment in the region of a connecting element.

In FIGS. 4 and 5, there is a purely diagrammatic representation in vertical section and view of an upper connecting region 110 of a further embodiment of a vacuum switch for medium voltage. This has an essentially tubular housing 112 made of insulating plastic with an approximately square cross-section. In the housing 112 there is a vacuum switch chamber 114 arranged, of which only the upper end region is shown in FIG. 4. The axis of the vacuum switch chamber is indicated by 114' and it runs in the same direction as the longitudinal axis of the housing 112. Above the vacuum switch chamber 114, in a perpendicular direction to the axis 114', a one-piece connecting element 116 leads out of the housing 112 in order to electrically connect the vacuum switch chamber 114 to connecting lines or busbars not shown in the Figures but generally known.

The essentially cylindrical vacuum switch chamber 112 has at the top a connecting surface 118 which is electrically connected in a known way to a fixed switching contact provided on the inside of the vacuum switch chamber 114. The connecting surface 118 of the vacuum switch chamber 114 rests against the connecting element 116 which is essentially rectangular in cross-section and is secured to the latter by means of two bolts 120 running in the direction of the axis 114'.

The tubular housing 112 encompassing the vacuum switch chamber 114 has for the connecting element 116 a passage 122, the cross-section of which is essentially rectangular as can be seen in particular in FIG. 5. The width B of the passage 122 essentially corresponds to the width of the connecting element 116, whereas the height H of the passage 122 is greater than the corresponding dimension of the connecting element 116. The housing 112 has in the region of the passage 122 a support tongue 124 which projects from below towards the connecting element 116 and against the end face of which the connecting element 116 rests.

Above the connecting element 116, in the free region of the passage 122 between the connecting element 116 and the housing 112, a wedge-shaped retaining element 126 is provided. The latter is introduced into the passage 122 from the outside and rests with its wedge surface 126' against the correspondingly sloping end wall 128 of the housing 112 and wedges the connecting element 116 in the passage 122. The retaining element 126 has in its region projecting into the inside of the housing 112 an elongated hole 130 extending in the longitudinal direction of the connecting element 116, through which elongated hole a securing bolt 132 running in the direction of the axis 114' is passed, said securing bolt being bolted into the retaining element 126 on the connecting element 116 in order to clamp it in position. The head of the securing bolt 132 is supported in a groove 133 in a retaining element 116, the base surface of which runs at right angles to the axis 114'.

On the housing 112 a tubular extension 134 is formed which encompasses at a distance the connecting element 116 in a direction extending away from the housing 112 over a part of its length.

Figure 7:
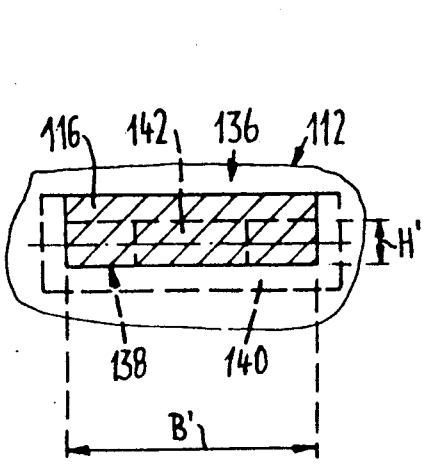
Figure 6:
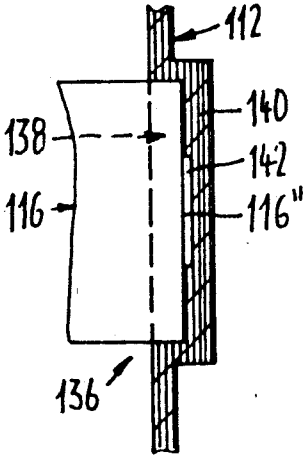

Opposite the passage 122 on the housing 112 there is provided a support point 136 for the connecting element 116 (FIGS. 6 and 7). The housing 112 has at the support point 136 an essentially parallelepiped-shaped recess 138 which is enclosed by an elevation 140 projecting toward the outside. The width B' of the recess 138 essentially corresponds to the width of the connecting element 116 and the height H' of the recess 138 is smaller than the height of the connecting element 116 over its length with the exception of its end region 116' on this side. In the end region 116', the connecting element 116 is tapered in its height in a step-like manner so that the cross-section of the region, engaging in the recess 138, of the connecting element 116 corresponds essentially to the cross-section of the recess 138.

The recess 138 has in its central region a depression 142 which extends, as shown in FIG. 7, over the entire height H' of the recess 138 and which corresponds in its width approximately to the width of the support tongue 124 (FIG. 5). By its end face 116'' on this side, the connecting element 116 rests in the recess 138 on the housing 112 except in the region of the recess 142. The connecting element 116 is thus supported in the recess 138 in the direction of the height and width as well as in the direction of its longitudinal extent.

To secure the connecting element 116 to the housing 112, the former is pushed through the passage 122 from the outside and introduced by its end region 116' into the recess 138 until it rests with its end face 116'' in the recess 138 on the housing 112. Then the wedge-shaped retaining element 126 is pushed from the outside between the connecting element 116 and the end wall 128 on the housing 112 until it sits there firmly and presses the connecting element 116 against the support tongue 124. With the securing bolt 132, the retaining element 126 is then fixed. Finally, the vacuum switch chamber 114 is secured with the bolt 120 on the connecting element 116.

FIGS. 8 to 11 show corresponding representations, like FIGS. 4 to 7, of the upper connecting region 10 of the same housing 112, the connecting element 144, however, being constructed both in the direction of its width and in its height to be smaller than the connecting element 116. Since the housing 112 shown in FIGS. 8 to 11 corresponds exactly to the housing shown in FIGS. 4 to 7, the housing is only described as much as is necessary for comprehension.

The height of the connecting element 144 essentially corresponds to the height H' of the recess 138 and depression 142. The width of the connecting element 144 is approximately the same as the width of the support tongue 124 and of the depression 142. With its end region 144' facing the recess 138, the connecting element 144 engages in the depression 142 of the recess 138 and rests with its end face 144'' against the housing 112. Thus, at the end region on this side, the connecting element 144 is supported in the depression 142 both in the direction of the width and in the height and in the direction of the longitudinal extent of the connecting element 144.

In the region of the passage 122, the connecting element 144 rests on the support tongue 124 and is pressed against the latter by means of a wedge-shaped retaining member 146 and is held wedged in the passage 122. The retaining member 146 is introduced opposite the connecting element 144 of the support tongue 124 into the free region between the connecting element 144 and the housing 112 of the passage 122. With its wedge surface 146' the retaining member 146 rests against the correspondingly sloped end wall 128 of the housing 112. Formed on the retaining member 146 are lateral retaining sides 148 which project downward and laterally encompass the connecting element 144 and the support tongue 124. Since the width of the connecting element 144 essentially corresponds to the width of the support tongue 124, the retaining sides 148 of the retaining member 146 thus fix the connecting element 144 to the support tongue 124 in the direction of width. The retaining member 146 is constructed to be larger in its height in comparison to the retaining element 126 (FIGS. 4 and 5) in order to be able to compensate for the free enlarged region, in accordance with the smaller height of the connecting element 144, between the retaining member 146 and the end wall 128. In the region projecting into the inside of the housing 112, the retaining member 146 has the elongated hole 130 running in the longitudinal extent of the connecting element 144, which hole is penetrated by the securing bolt 132 bolted into the connecting element 144. The head of the securing bolt 132 rests in the groove 133 on the retaining member 146.

The necessary cross-section of the connecting element 116 or 144 is determined by the current to be conducted. The connecting element 116 shown in FIGS. 4 to 7 can thus conduct greater currents than the connecting element 144 according to FIGS. 8 to 11 which is smaller in cross-section. According to the nominal and short-circuit currents to be conducted and interrupted, the vacuum switch chambers 114 can also be constructed in different ways. Thus, the vacuum switch chamber 114 shown in FIG. 8 has a smaller height than the vacuum switch chamber 114 shown in FIG. 4. In order to compensate for these different dimensions in the same housing 112, according to FIG. 8 there is arranged between the connecting surface 118 of the vacuum switch chamber 114 and the connecting element 144 a sleeve 150 made of electrically conductive material, which sleeve is penetrated by the bolt 120 which secures the vacuum switch chamber 114 to the connecting element 144. The axis of the vacuum switch chamber is designated by 114'.

When mounting the connecting element 144 which is constructed as one piece, it is passed from the outside through the passage 122 and introduced by its end region 144' into the depression 142 of the recess 138 until it rests with its end face 144'' on the housing 112. Then, the retaining member 146 is mounted on the connecting element 144 and pressed in between the connecting element and the wall, 128. The retaining member 146 is then fixed to the connecting element 144 with the securing bolt 132. The connecting element 144 is thus aligned in all directions and held secure in the region of the support point 136, in the depression 142 and in the region of the passage 122 by the support tongue 124 and the retaining member 146. The retaining sides 148 ensure an exact alignment of the connecting element 144 in relation to the support tongue 124. Finally, the vacuum switch chamber 114 is then also secured with the bolt 120, with the sleeve 150 being inserted, to the connecting element 144 in the direction of the axis 114'.

For the sake of completeness it should be noted that the connecting elements 116 and 144 are produced from flat semi-finished products. The corners and edges of the connecting element 116, 144 are rounded off in order to avoid high field strengths and partial discharging. On the profile-shaped connecting element 116, 144 only slight working is required. Thus, the holes for the bolts 120 and the thread for the securing bolt 132 and, if necessary, a contact surface are to be made on the connecting element 116, 144 in order to ensure a low impedance current transition between the vacuum switch chamber 114 or the sleeve 150 and the connecting element 116, 144. With connecting elements 116, the height of which is greater than the height H' of the recess 138, the end region 116' is to be appropriately worked in order to ensure the engagement in the recess 138. The housing 112 is advantageously cast as one piece or molded. The housing 112 can of course also be constructed as a hollow cylinder. For the sake of completeness it should be noted that in the embodiment of the housing 112 shown in FIGS. 4 to 11 having an approximately square cross-section, the passage 122 and the support point 136 are preferably located on two opposite flat sides of the housing 112.

We claim:

1. A vacuum switch for medium voltage, said vacuum switch comprising:

a vacuum switch tube, a substantially tubular housing being open at opposite axial ends and made of insulating material, said vacuum switch tube being located in and surrounded by said tubular housing with a space defined between said vacuum switch tube and said tubular housing, and said tubular housing extending axially beyond said vacuum switch tube, said vacuum switch tube being secured to a connecting element, said connecting element penetrating said tubular housing in a transverse direction in relation to its longitudinal axis through a passage and being supported in a recess of the tubular housing located opposite the passage, said connecting element being constructed as one piece and extending through the passage from outside of said tubular housing and said vacuum switch tube being secured tight to said connecting element in an axial direction.

2. A vacuum switch as claimed in claim 1, wherein said connecting element and the passage have an essentially rectangular cross-section.

3. A vacuum switch as claimed in claim 2, wherein the cross-section of the passage is greater than the cross-section of the connecting element, and in a free region of the passage located between said housing and said connecting element, a wedge-shaped, fixable retaining element is provided for wedging said connecting element in the passage.

4. A vacuum switch as claimed in claim 3, wherein said retaining element is fixable by means of a securing bolt to said connecting element.

5. A vacuum switch as claimed in claim 3, wherein the cross-section of said connecting element, both in the direction of width and also height of the passage is smaller than the cross-section of the latter, and wherein said retaining element, viewed in a longitudinal direction of said connecting element, has sides laterally encompassing said connecting element and is fixed to the housing in a transverse direction in relation to the sides.

6. A vacuum switch as claimed in claim 5, wherein the housing has, in a region of the passage, on the opposite side of said connecting element to the retaining element, a support tongue projecting toward said connecting element and supporting the connecting element and the sides of the retaining element for its fixing into a region of the support tongue.

7. A vacuum switch as claimed in claim 1, wherein the support point opposite the passage has a recess in the housing constructed to be stepped for the purpose of supporting connecting elements with different cross-sections.

8. A vacuum switch as claimed in claim 7, wherein the recess has an essentially rectangular cross-section and has in its central region a step-shaped depression.

9. A vacuum switch as claimed in claim 1, wherein said connecting element is secured to said housing at the support point.

10. A vacuum switch as claimed in claim 9, wherein said housing has at the support point a further passage, running in the radial direction, and penetrated by a spigot provided on said connecting element, on which a bracing part sits on the outside of said housing to secure said connecting element to said housing.

11. A vacuum switch as claimed in claim 10, wherein said bracing part is covered by a pocket-shaped covering open in an axial direction of said housing and made of insulating material.

12. A vacuum switch as claimed in claim 11, wherein said covering is formed on said housing.

13. A vacuum switch as claimed in claim 1, wherein said connecting element is arranged above said vacuum switch tube, said vacuum switch tube being secured to said connecting element by a bolt connection penetrating said connecting element from above.

14. A vacuum switch as claimed in claim 1, wherein at a free end of said connecting element, an isolating contact is provided.

15. A vacuum switch as claimed in claim 1, wherein said housing has a tubular covering protruding in the radial direction toward the outside and surrounding said connecting element at least over a part of its length projecting beyond the housing.

* * * * *